United States Patent [19]

Foster et al.

[11] 4,041,586

[45] Aug. 16, 1977

[54] TEXTILE FLUID BULKING PROCESS

[75] Inventors: Peter William Foster; Duncan Cameron Ferrier; Thomas Berry, all of Tiverton, England; Karel Murenbeeld, Geneva, Switzerland

[73] Assignee: John Heathcoat & Company Limited, Tiverton, England

[21] Appl. No.: 599,786

[22] Filed: July 28, 1975

[30] Foreign Application Priority Data

July 31, 1974 United Kingdom ..... 33884/74

[51] Int. Cl.[2] ..... D02G 1/20; D02G 1/16; D02G 1/12

[52] U.S. Cl. ..... 28/254; 28/265; 28/271

[58] Field of Search ..... 28/1.3, 72.11, 72.12, 28/1.4, 1.6, 1.7, 72.12, 72.14; 428/364

[56] References Cited

U.S. PATENT DOCUMENTS

| | | | |
|---|---|---|---|
| 3,256,582 | 6/1966 | Burleson | 28/1.3 |
| 3,296,677 | 1/1967 | Chase | 28/1.3 |
| 3,832,759 | 9/1974 | Eskridge et al. | 28/1.3 |
| 3,879,821 | 4/1975 | Stanley | 28/1.3 |
| 3,885,278 | 5/1975 | Whitaker | 28/1.3 |
| 3,936,916 | 2/1976 | Borenstein et al. | 28/72.14 X |
| 3,961,402 | 6/1976 | Ferrier et al. | 28/72.14 |
| 3,977,058 | 8/1976 | Borenstein et al. | 28/1.7 |
| 3,977,059 | 8/1976 | Allen et al. | 28/72.11 |

*Primary Examiner*—Louis K. Rimrodt
*Attorney, Agent, or Firm*—Larson, Taylor and Hinds

[57] ABSTRACT

A bulked multifilament yarn having filaments of polymeric material has alternating points of maximum polymeric density and minimum polymeric density occurring along the length of each filament with a maximum spacing of 10 meters. The yarn may have a crimped structure in which the crimps are of undulating form with more than 50% of the filaments having maximum amplitudes of undulation less than the diameter of the yarn and more than 50% of each filament lies on one side of a diametral plane of the yarn particular to that filament. A process of producing the yarn includes the steps of jet bulking yarn and projecting it against one end of an elongated package during which the pressure prevailing at said one end of the package fluctuates. The pressure varies between a maximum value and a minimum value with a frequency related to the rate of feed of the yarn.

1 Claim, 2 Drawing Figures

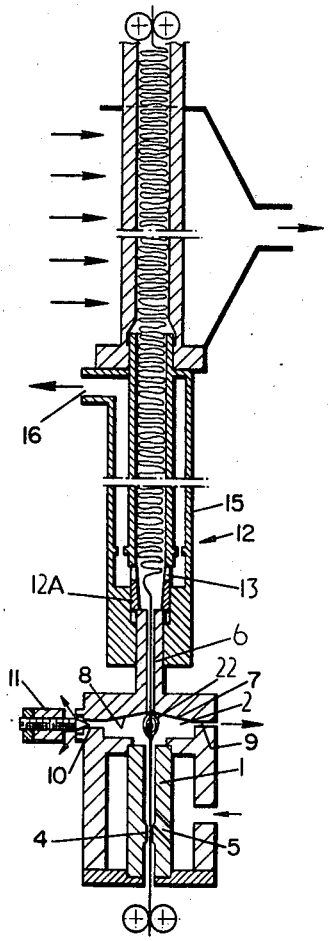

TEXTILE FLUID BULKING PROCESS

Figure 1:
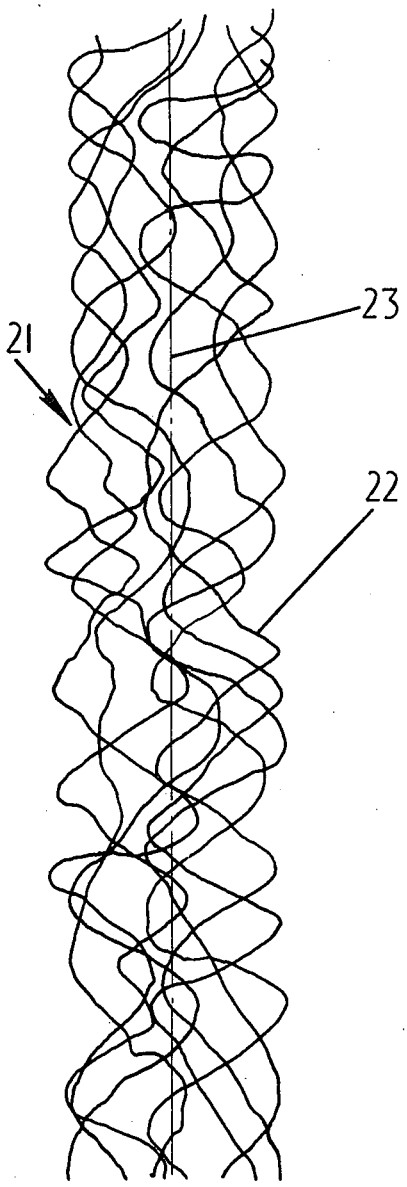

The subject of this invention is a bulked multifilament yarn. Such yarns are often referred to as textured yarns because the bulking operation always imparts a degree of crimping to the individual filaments forming the yarn.

Bulked yarns per se are well known in the textile industry. The object of bulking a yarn particularly a synthetic yarn is to produce a yarn having improved qualities of feel and softness. An article made from an unbulked synthetic yarn tends to be hard and cold to the touch.

Yarns bulked by different processes have internal structures which differ in some ways although they all exhibit to some extend improved feelings of softness and warmth. Bulked synthetic yarns can be made to have the feeling of yarns consisting of or containing natural fibres. However, known bulked yarns have suffered from some defects. The quality of bulking particularly as exemplified by the pattern of the heat treatment given to the individual filaments during the bulking operation has been found to have a considerable effect on characteristics of the yarn not connected with the feel and softness of the yarn. The most important characteristic affected is that of dye take up.

Ever since bulked textured yarn was first produced with the object of giving synthetic fibre something of the appearance and feel of natural fibres it has been the aim of producers of such yarn to obtain complete evenness of dye take up along the length of the yarn. This has been almost completely achieved mainly by maintaining close control of the heat treatment and known yarns now exhibit at most only a very low amplitude low frequency variation of dye take up. The variation is often of such low frequency that it only appears as a variation from one yarn package to another. However, in fabrics of large area woven or knitted from the known yarns such a low frequency variation is often visible to the discerning eye as a patchiness in the colour or as bars of different shade according to the weaving or knitting process employed. Even where the colour appears to be even some observers find that the fabric does not have the liveliness and three dimensional look that it would have if it were made of natural fibre.

The inventors of the present invention have given close study to this phenomenon and have discovered that it is not in fact desirable that the rate of dye take up should be as nearly constant as possible along the yarn. They have found that the liveliness and richness of colour of a fabric made from synthetic yarn is much improved by arranging that the fabric consists of a mosaic of small closely spaced areas of different shades of the same colour. The eye sees the average of these different shades. This effect can be achieved by making the fabric from yarn which has the characteristic that its rate of taking up dye varies along its length with a frequency very much higher than is obtainable in any known yarn. This finding is completely counter to the beliefs previously held in the yarn bulking field. It has also been found that the invention is able to provide easily effects falling into the category known in the industry as tone on tone space dyed effect. Such an effect is in high demand but is difficult and expensive to achieve by known methods.

To fulfill the inventors' findings it was necessary to produce a yarn having a particular frequency of variation of dye take up lying within a range which would previously have been considered totally unacceptable.

The invention is based on the finding that the thermal treatment given to a filament of polymeric material determines the spatial arrangement of the constituent molecules of the polymer and thus the density of the polymer and at the same time also determines the dye take-up characteristics of the filament. The value of the density of the polymer at any particular part of a polymeric filament is thus a measure of the dye take up characteristics of that part of the filament.

The present applicants have succeeded in postulating a structure for a yarn which has the desired dye take-up characteristics.

According to the invention, a bulked multifilament yarn having filaments formed of at least one polymer is characterized in that the spatial arrangements of the constituent molecules of the polymer change along the lengths of the filaments to provide alternating points of maximum density and minimum density occurring with a maximum spacing of 10 meters.

The change in the spatial arrangements of the constituent molecules of the polymer forming any filament appears as a change in the ratio of the amount of crystalline structure to amorphous structure present in any increment of the filament as shown by X-ray diffraction, crystalline and amorphous forms of the same polymer having different densities.

The yarn may additionally have a physical structure in which the individual filaments have crimps of an undulating contour, more than 50% of the filaments have maximum amplitudes of undulation less than the diameter of the yarn and, after removal of any twist which may have existed in the yarn before the filaments were crimped, more than 50% of each filament lies on one side of a diametral plane of the yarn particular to that filament.

A process of producing yarn according to the invention includes the steps of entraining a multifilament yarn in a stream of fluid at a temperature high enough to plasticize the yarn and projecting the yarn as a continuous operation against one end of an elongated package of already bulked yarn while the pressure prevailing at said one end of the package is caused to fluctuate between a maximum value and a minimum value with a frequency per second which is at least 1/600 the speed in meters per minute of the yarn just before it comes against one end of the plug.

An apparatus which is capable of being made to operate to produce such a yarn is described and claimed in commonly assigned prior patent application Ser. No. 362 350, now U.S. Pat. No. 3,965,547, issued June 29, 1976, the application having been filed on May 21, 1973, as a division of U.S. application Ser. No. 130,899, filed Apr. 25, 1971, now U.S. Pat. No. 3,810,285, issued May 4, 1974. How the said apparatus may be made to operate in the necessary manner is described later in this specification. The drawing illustrating the apparatus of that prior patent specification is reproduced in this specification.

Figure 2:
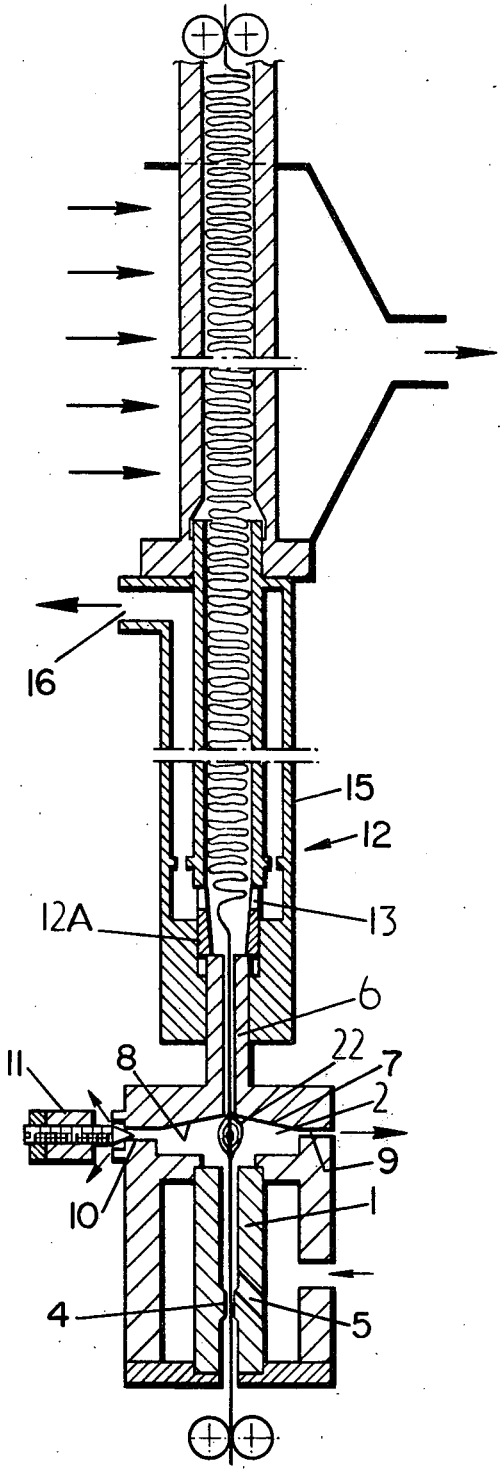

FIG. 1 of the accompanying drawings is an enlarged view of a yarn according to the invention showing the physical structure of the yarn. It will be recognized that it is not readily practicable to show the molecular structure. FIG. 2, reproduced from the prior patent application Ser. No. 362 350 shows apparatus capable of producing yarn according to the invention.

In FIG. 1, which is a view on a diametral plane of the yarn, 21 denotes generally the yarn which has had removed from it any twist which may have existed in the yarn prior to the formation of the crimps, 22 denotes individual filaments and 23 denotes a diametral plane of the yarn at right angles to the plane of the drawing.

The filaments 22 have crimps of an undulating contour. It will be noted that much the greater part of each filament lies on one particular side of the plane 23. The same construction is to be observed in views on other diametral planes of the yarn. The amplitude of the undulations of most filaments thus does not exceed greatly the radius of the yarn whereas in known bulked yarns the filaments undulate with an amplitude usually approximately equal to the diameter of the yarn with a pitch large in proportion. The small amplitude of the undulations of the filaments of the yarn of the present invention is accompanied by a pitch smaller than that of the filaments of known bulked yarns.

For a detailed description of the apparatus shown in FIG. 2, reference may be had to the previously mentioned patents, since an abbreviated description will suffice for purposes of the instant invention. In FIG. 2, 1 denotes a high pressure fluid passage, and 2 denotes an intermediate pressure chamber into which the passage 1 debouches. Numerals 4 and 5 denote entries for yarn and for high-pressure gaseous fluid into the passage 1. The chamber 2 is formed with a yarn-discharge passage 6, the entry to which is located in the wall 7 across the chamber 2 from the debouchment of the passage 1 into the chamber 2. The chamber 2 contains a yarn-deflecting surface 8 constituted by the coned wall 7 of the chamber 2, located across the chamber 2 from the debouchment of the passage 1, and 9 and 10 denote bleed-off openings from the chamber 2, the opening 9 being uncontrolled and the opening 10 being associated with a needle valve 11 operable to vary the effective area of the opening 10.

The crimp-setting section of the apparatus incorporates a stuffer tube 12 disposed co-axial with the yarn-discharge passage 6 and formed with lateral ports 13 at the end adjacent to the yarn-discharge passage 6. The portion 12A of the stuffer tube 12 is formed with lateral ports 13. Numeral 15 denotes a jacket surrounding most of the length of the stuffer tube, the ports 13 opening into the jacket 15, which has an exhaust opening 16. Numeral 22 denotes the yarn filaments separated in the intermediate pressure chamber 2. The other illustrated features will be readily understandable from the drawing itself, or by reference to the previously mentioned patents.

In the apparatus illustrated in FIG. 2 it is the portion 12A of the stuffer tube which is mainly operative when the appropriate fluid pressure conditions are set to provide the fluctuating pressure required to alter the thermal treatment of the yarn and thus the spatial arrangements of the constituent molecules with corresponding alterations in the density and the dye take up characteristics of the polymer or polymers of which the filaments of the yarn being bulked in the apparatus are made. It has been found that under appropriate operating conditions the yarn plug tends to form in the portion 12A between the end of the passage 6 and the ports 13. Pressure then builds up in the portion 12A and the yarn plug is pushed towards the ports 13 faster than it can build up in the opposite direction towards the passage 6 by the addition of yarn to it. When the end of the yarn plug uncovers the ports 13 there is a very rapid drop of pressure in the portion 12A. As soon as the pressure in the portion 12A is released the plug stops moving away from the passge 6. The normal plug build up then causes the ports 13 to be covered and the cycle is repeated.

A change is pressure of a gaseous fluid is not necessarily accompanied by a change in temperature, for examples pressure can be changed under isothermal conditions. The change in thermal treatment of the yarn which is the basis of the present invention and which is caused by the change in pressure occurring as described above is thought to be the result of a very different mechanism.

The change in pressure occurring at the end of the package against which the yarn is projected, i.e. in the portion 12A is believed to change the traction exerted by the gaseous fluid on the yarn coming through the passage 6 by reason of the change in velocity of the fluid issuing from the passage 6 along with the yarn resulting from the change in pressure drop experienced by the fluid and thus to change the tension in the portion of the yarn extending from the debouchment of the nozzle 1 through the intermediate chamber 2, through the passage 6 and into the portion 12A. The effect of this fluctuating tension is to change continuously the degree of separation of the filaments occurring in the intermediate chamber 2. It may be explained that when a yarn is being bulked in a jet of fluid the filaments separate from one another to an extent depending on the magnitude of the tension applied to the yarn. The amount by which the filaments separate from one another is the major condition which determines the heat-exchanging conditions between the filaments and the fluid and thus the thermal treatment of the yarn. The fluctuating changes in the tension in the yarn are thus able to cause the required fluctuating changes in the spatial arrangement of the molecules making up the polymer of which the yarn is composed.

The parameters which require to be changed with respect to the illustrated apparatus to provide the yarn of the invention can be operating parameters and/or dimensional parameters.

One operating parameter which can be changed to provide the novel yarn is the degree of overfeed with a corresponding change in the temperature of heating medium to ensure the requisite rate of heat transfer to the yarn. All bulking device must be fed faster than the bulked yarn taken off the device to compensate for the loss of length occurring in the bulking process.

Another operating parameter which can be changed to provide the novel yarn is the pressure of the gaseous fluid supplied to the apparatus.

It is easy once the basic concept is understood to determine the operating parameters in such a way as to provide yarns the filaments of which, while forming yarn structures lying within the definition given in this specification, have dye take up abilities which vary along the length of the yarn with a frequency lying within either a low range of frequencies having maximum and minimum values occurring at intervals in a range between 10 meters and about three cm. along the filaments in which the variation is visible yet the frequency is high enough to provide a wide range of pleasing mottled effects within which lie the tone on tone space dyed effects to which reference has already been made, or a high range of frequencies having maximum and minimum values occurring at intervals below about three cm. along the filaments in which the variation is not detectable by the unaided human eye thus providing if desired at least the same degree of evenness of shade as known yarns but with the additional effect of greater liveliness and depth of tone. These desirable characteristics are not obtainable in the known bulked yarns.

The following examples are illustrative of the processes for producing yarn of known type and yarn according to the invention.

EXAMPLE I

"Tersuisse" polyester yarn having 30 filaments each of a decitex count of 167 was fed to an apparatus constructed substantially as illustrated in FIG. 2 at a speed of 1100 meters per minute using steam at the normal operating pressure of 5½ atmospheres and a steam temperature of 185° C. The bulked yarn was taken off from the apparatus at a speed of 880 meters per minute giving a normal operating overfeed of 20%. The bulked yarn was of good regular quality and when dyed showed an evenness of dye take up which was very high by present standards but no detectable rhythmical change in dyeability.

EXAMPLE II

Yarn exactly the same as in Example I was fed to the same apparatus as that used in connection with Example I at a speed of 1100 meters per minute using steam at the normal operating pressure of 5½ atmospheres and a steam temperature of 235° C. The bulked yarn was taken off from the apparatus at a speed of 704 meters per minute thus providing an overfeed of 36%. The bulked yarn was of good regular quality and when dyed by the same dye and dyeing process as in Example I showed a continuous variation in dye take up along the length of the yarn with points of maximum dye take up occurring at an average interval of about 10 cm. When made up into a garment the fabric of the garment when viewed at close quarters showed a pleasing mottled effect in the form of a mosaic pattern of random closely spaced small areas of different shades of the same colour with darker shades predominating and when viewed at a distance showed great overall evenness of colour coupled with a richness and depth of tone.

EXAMPLE III

Yarn exactly the same as in Example I was fed to the same apparatus as that used in connection with Example I at a speed of 1100 meters per minute using steam at a pressure of 9 atmospheres and a steam temperature of 184° C. The bulked yarn was taken off from the apparatus at a speed of 880 meters per minute giving a normal operating overfeed of 20%. The bulked yarn was of good regular quality and when dyed by the same dye and dyeing process as in Example I showed a continuous variation in dye take up along the length of the yarn with points of maximum dye take up occurring at an average spacing of about 10 cm. When made up into a garment the fabric of the garment showed at close quarters a pleasing mottled effect in the form of a mosaic pattern of randomly spaced small areas of different shades of the same colour with lighter shades predominating and when viewed at a distance showed a great overall evenness of a colour lighter than the colour obtained in Example II but with a comparable richness and depth of tone.

In the examples quoted it is the distance between points of maximum dye take up which were measured because these are more easily measured. The points of minimum dye take up were approximately midway between the points of maximum dye take up but were not measured because the exact positions of the points of minimum dye take up are not so readily discernable as those of maximum dye take up.

It is believed that the higher overfeed causes a greater mass of yarn to accumulate in the divergent portion 12A thus causing an increase in friction above normal, giving rise to the intermittent forward movement described and which reacts on the bulked yarn to change its dye take up characteristic rhythmically. Different amounts of overfeed provide different frequencies of change of dye take up making it possible to control the effect within the limits defined in this specification. Pressure changes operate similarly.

While experiments are not yet complete to determine what dimensional changes may be made in the apparatus to provide the yarn of the invention preliminary work indicates that a change in the dimensions of the part or parts making up the intermediate chamber 2 and/or the portion 12A from the dimensions used in current production is most likely to provide the desired effect without requiring much or even any overfeed beyond that normal in jet bulking apparatus and with little or no increase in the pressure of the operating fluid.

Known bulking apparatus even employing stuffer tubes do not and cannot operate in the manner described to produce the yarn of the invention. The volume of the portion 12A is so small that a useful pressure drop in the portion is obtainable only by maintaining almost constant the rate of discharge of fluid from the passage 6 into the portion 12A. In known apparatus any reduction in pressure in the stuffer tube is immediately compensated by an increased flow of high pressure fluid from the bulking nozzle. In the apparatus illustrated the intermediate chamber 2 is of finite volume and that fact and the substantially constant intermediate pressure prevailing therein introduce sufficient of a time lag to prevent immediate compensation by the bulking nozzle for the drop in pressure in the portion 12A when the ports 13 are uncovered. In known stuffer tube apparatus any fluctuation of pressure in the stuffer tube is a supply fluctuation and is of very low frequency.

What is claimed is:

1. A process of producing a bulked multifilament yarn having filaments formed of at least one polymer comprising causing a multifilament yarn to be entrained in a stream of fluid at one pressure and at a temperature high enough to plasticize the yarn, causing the fluid to discharge into a space of finite volume maintained at a lower pressure by controlled escape of fluid from the space whereby to separate the filaments in the space and thus to bulk the yarn, then causing the bulked yarn to be entrained in a second stream of fluid flowing from said space and to be projected as a continuous operation against one end of an elongated package of already bulked yarn contained in a second space into which the second stream of fluid discharges and in which the pressure is caused to fluctuate between a maximum value and a minimum value with a frequency per second which is at least 1/600 the speed in meters per minute of the yarn just before it comes against said one end of the elongated package.

* * * * *